US005848943A

United States Patent [19]

Sano et al.

[11] Patent Number: 5,848,943

[45] Date of Patent: Dec. 15, 1998

[54] GOLF BALL

[75] Inventors: Yoshinori Sano, Shirakawa; Kuniyasu Horiuchi, Kobe, both of Japan

[73] Assignee: Sumitomo Rubber Industries, Ltd., Hyogo-ken, Japan

[21] Appl. No.: 863,016

[22] Filed: May 23, 1997

[30] Foreign Application Priority Data

May 24, 1996 [JP] Japan ..... 8-153147

[51] Int. Cl.[6] ..... A63B 37/12

[52] U.S. Cl. ..... 473/365; 473/373; 473/377; 473/385

[58] Field of Search ..... 473/377, 365, 473/373, 374, 385

[56] References Cited

U.S. PATENT DOCUMENTS

| | | | |
|---|---|---|---|
| 5,633,322 | 5/1997 | Yabuki et al. | 473/377 X |
| 5,663,235 | 9/1997 | Tanaka et al. | 473/385 X |
| 5,674,137 | 10/1997 | Maruko et al. | 473/354 |
| 5,688,595 | 11/1997 | Yamagishi et al. | 473/377 X |
| 5,695,413 | 12/1997 | Yamagish et al. | 473/351 X |

*Primary Examiner*—George J. Marlo

[57] ABSTRACT

A golf ball comprising a core and a cover formed on the core, wherein the cover is formed from a mixture of an ionomer resin and an epoxy group containing a polymer or an OH group containing a soft elastomer and has a thickness of from 0.4 to 1.85 mm, a flexural modulus of from 100 to 1,500 kgf/cm$^2$ and a shore D hardness of from 30 to 65.

5 Claims, 2 Drawing Sheets

GOLF BALL

FIELD OF THE INVENTION

The present invention relates to a golf ball. More particularly, the presents invention relates to a golf ball having good shot feel and good controllability on approach shots, as well as excellent flight performance and good cut resistance.

BACKGROUND OF THE INVENTION

Ionomer resins and balata (transpolyisoprene) are generally used as the base resin for golf ball covers. These two types of resins have specific advantageous features, that is, the former exhibits excellent cut resistance and excellent rebound characteristics, and the later exhibits excellent shot feel and excellent controllability.

Furthermore, ionomer resins is usually employed for the covers of two-piece solid golf balls, because they are easily molded in comparison with balata.

In order to increase rebound characteristics in a golf ball formed from an ionomer resin cover, it is suggested that the thickness of the cover be adjusted to 2.1 to 2.5 mm as described in, for example, Japanese Patent Kokai publications Nos. 37961/1984, 49780/1984, etc.

However, since the ionomer resin has a high hardness and rigidity, the thickness adjustment to 2.1–2.5 mm increases shot impact when hitting, and reduces the spin amount, resulting in poor shot feel and poor controllability.

In order to improve shot feel and controllability of a golf ball employing an ionomer resin cover, it has been to mix the ionomer resin with a soft resin to make it soft.

For example, U.S. Pat. No. 4,884,814 and Japanese Patent Kokai publication No. 308677/89 propose that the rigid ionomer resin be mixed with a soft ionomer formed from the sodium salt or zinc salt of ethylene-(meth)acrylic acid-(meth)acrylic acid ester terpolymer.

The blending method of softening the ionomer resin improves shot feel and controllability, but adversely affects flight performance and cut resistance. Thus, golf balls having a satisfied performance using the blending method have not been obtained.

OBJECTS OF THE INVENTION

Accordingly, the main object of the present invention is to provide a golf ball having excellent flight performance and good shot feel and good cut resistance, as well as good controllability for meeting the requirements of professional golfers and high handicap amateur golfers. Such a golf ball can be obtained by using an ionomer resin which imparts good shot feel and controllability to golf balls and which maintains the excellent rebound characteristics and excellent cut resistance inherent in ionomer resins.

According to the present invention, the object described above has been accomplished by employing a cover which is adjusted to a specified thickness, specified flexural rigidity and specified surface hardness, thus providing a golf ball having good shot feel and good controllability on approach shots, and excellent flight performance and good cut resistance.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
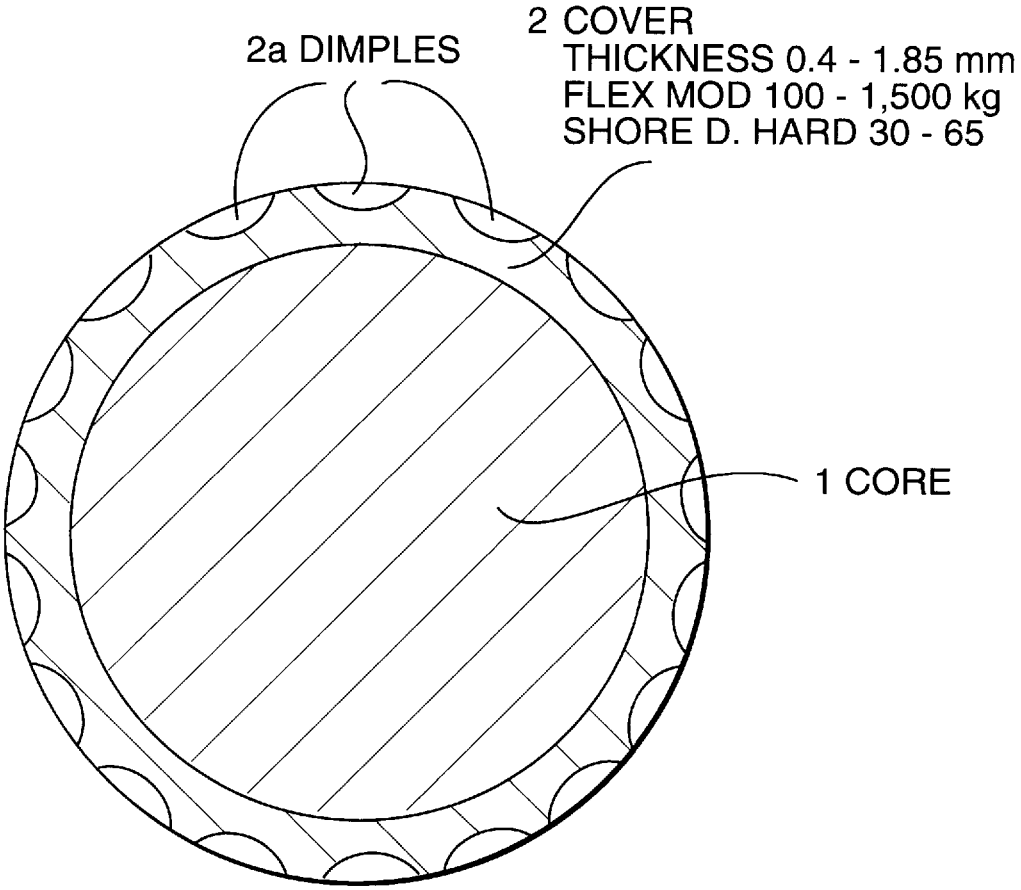
FIG. 1 is a schematic cross section illustrating one embodiment of the golf ball of the present invention.

The present invention provides a golf ball comprising a core and a cover formed on the core, wherein the cover has a thickness of from 0.4 to 1.85 mm, a flexural modulus of from 100 to 1,500 kgf/cm$^2$, and a Shore D hardness of from 30 to 65.

The golf ball of the present invention has good shot feel and proper spin amount when hit by a wood club, with good flight distance and a flight performance which is equal to or better than conventional golf balls using a high rigid ionomer resin cover. The golf ball further has a soft shot feel and controllability equal to or better than thread wound golf balls using balata type of cover when it is hit by middle irons or short irons.

DETAILED DESCRIPTION OF THE INVENTION

The cover used in the present invention has a thickness of 0.4 to 1.85 mm, which is less than that of conventional golf balls, which provides good shot feel and good controllability on approach shots, and does not degrade flight performance and cut resistance, while maintaining good moldability. When the thickness is less than 0.4 mm, it is difficult to mold the material into a golf ball form. Also the cut resistance of the golf ball is reduced, and the spin amount is increased so much that it is difficult to retain a good flight performance. When the thickness is larger than 1.85 mm, the spin amount is reduced, which degrades controllability, and the shot feel is hard because the properties inherent in ionomer resins appear. It is preferred that the cover has a thickness of 0.5 to 1.7 mm.

Also, the cover used in the present invention has a flexural modulus of less than 1,500 kgf/cm$^2$ in order to make the shot feel soft and improve controllability. When the flexural modulus is more than 1,500 kgf/cm$^2$ the shot feel is poor and, the spin amount is reduced, thus degrading controllability. The lower the flexural modulus of the cover, the better is the shot feel and controllability of the ball. However, if the flexural rigidity of the cover is too low, it is difficult to obtain the desirable flight performance by reducing rebound characteristics. It is therefore required that the cover preferably has a flexural modulus of more than 100 kgf/cm$^2$, and, it is preferable that the cover has a flexural modulus of 500 to 1,200 kgf/cm$^2$. The flexural modulus of the cover is determined according to ASTM D-747, using as a sample a heat and press molded sheet having a thickness of about 2 mm and taken from the cover composition, which has been stored at 23° C. for 2 weeks.

Further, the cover used in the present invention has a Shore D hardness of 30 to 65, which is lower than that of conventional golf balls, which exhibits good shot feel while maintaining excellent repulsion performance and durability. If the cover has a Shore D hardness of less than 30, the repulsion and cut resistance of the ball is degraded. If the cover has a Shore D hardness of more than 65, the cover is too hard, and thus the shot feel is degraded. Particularly, it is preferable that the cover has a Shore D hardness of 40 to 55. The Shore D hardness of the cover is determined according to ASTM D-2240, using as a sample of a heat and press molded sheet having a thickness of about 2 mm taken from the cover composition, which has been stored at 23° C. for 2 weeks.

It is preferable that the cover is formed from a base resin mainly containing an ionomer resin or a mixture of an ionomer resin and a soft elastomer.

The ionomer resin can be either a copolymer of α-olefin and α,β-unsaturated carboxylic acid having 3 to 8 carbon atoms, of which a portion of carboxylic acid groups is neutralized with a metal ion, or a terpolymer of α-olefin and α,β-unsaturated carboxylic acid having 3 to 8 carbon atoms and an ester of α,β-unsaturated carboxylic acid having 2 to 22 carbon atoms, of which a portion of the carboxylic acid groups is neutralized with metal ion.

Examples of the α-olefins are ethylene, propylene, 1-butene, 1-pentene and the like, but ethylene is particularly preferable. The α,β-unsaturated carboxylic acid described above includes acrylic acid, methacrylic acid, fumaric acid, maleic acid, crotonic acid and the like, but acrylic acid and methacrylic acid are particularly preferable. The metal ion which neutralizes a portion of the carboxylic acid groups of either a copolymer of α-olefin and α,β-unsaturated carboxylic acid or a terpolymer of α-olefin and α,β-unsaturated carboxylic acid having 3 to 8 carbon atoms and an ester of α,β-unsaturated carboxylic acid having 2 to 22 carbon atoms includes a sodium ion, a lithium ion, a zinc ion, a magnesium ion, a potassium ion and the like.

The ionomer resin is not limited, and examples thereof will be shown by a trade name thereof. Examples of the ionomer resin, which is commercially available from Mitsui Du Pont Polychemical Co., include Hi-milan 1555 (Na), Hi-milan 1605 (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg) and Hi-milan MK7320 (K); and Hi-milan 1856 (Na), Hi-milan 1855 (Zn) and Hi-milan AM7316 (Zn) as the terpolymer ionomer resin. Examples of the ionomer resin, which is commercially available from Du Pont U.S.A., include Surlyn 8920 (Na), Surlyn 8940 (Na), Surlyn AD8512 (Na), Surlyn 9910 (Zn), Surlyn AD8511 (Zn), Surlyn 7930 (Li) and Surlyn 7940 (Li); and Surlyn AD8265 (Na) and Surlyn AD8269 (Na) as the terpolymer ionomer resin. Examples of the ionomer resin, which is commercially available from Exxon Chemical Co., include Iotek 7010 (Zn) and Iotek 8000 (Na). These ionomer resins are used alone or in combination thereof. Incidentally, Na, Zn, Li, K and Mg, which are described in parentheses after the trade name of the above ionomer resin indicate their neutralizing metal ion species.

Examples of the soft elastomer to be mixed with the ionomer resin include a functional group-modified olefin elastomer, such as maleic anhydride-modified styrene-butadiene block copolymer or maleic anhydride-modified ethylene-ethyl acrylate copolymer, epoxy group-containing styrene-butadiene block copolymer or epoxy group-containing ethylene-ethyl acrylate copolymer, OH group-containing styrene-butadiene block copolymer or OH group-containing styrene-isoprene block copolymer and the like; polyetherester; polyamide; ethylene-propylene-dien elastomer, and the like.

Examples of the maleic anhydride-modified soft elastomers are maleic anhydride adducts of hydrogenated styrene-butadiene-styrene block copolymers, which are commercially available from Asahi Chemical Industries Co., Ltd. under the trade name of "Taftek M" series; ethylene-ethyl acrylate-maleic anhydride terpolymers, which are commercially available from Sumitomo Chemical Industries Co., Ltd. under the trade name of "Bondine"; and products obtained by graft-modifying ethylene-ethyl acrylate copolymers with maleic anhydride, which are commercially available from Mitsui DuPont Polychemical Co., Ltd. under the trade name of "AR" series.

Examples of the epoxy group-containing polymers include SBS structured block copolymer having polybutadiene block with epoxy groups, which are commercially available from Daicel Chemical Industries Co., Ltd. under the trade name of "ESBS AT014", "ESBS AT015", "ESBS AT000" and the like; and SBS structured copolymer having a polybutadiene block with an epoxy group, which is then hydrogenated, commercially available from Daicel Chemical Industries Co., Ltd. under the trade name of "ESBS AT018", "ESBS AT019" and the like. In this context, the term "SBS structure" means a polystyrene-polybutadiene-polystyrene structure in which polybutadiene block is sandwiched by two polystyrene blocks.

Examples of the OH group-containing soft elastomers include, for example, hydrogenated styrene-isoprene-styrene block copolymers having terminal OH groups, which are commercially available from Kuraray Co., Ltd. under the trade name of "HG-252".

The cover used in the present invention may optionally contain various additives such as pigments, dispersants, antioxidants, UV absorbers, photostabilizers, etc., in addition to the resin component. When the cover composition is prepared, the mixture of ionomer resins or the mixture of ionomer resin and soft elastomer used as the base resin may be premixed, or preliminarily mixed and then mixed with the additives, or directly mixed with the additives during preparation of the cover composition. As used herein, the term "base resin" means the resin component in the cover composition that it only consists of the base resin and it consists of the base resin by adding other resins in part.

The cover is then covered around the core to obtain the golf ball. The core used may be either a core for solid golf balls (solid core) or a core for thread wound golf balls (thread wound core). The core exhibits a deformation amount of 2 to 4.5 mm when applying an initial load of 10 Kg to a final load of 130 Kg, whether it is a thread wound core or a solid core.

The solid core may have a single layer structure or multi-layers structure. The core for two-piece golf ball may be obtained by vulcanizing (crosslinking) or press-molding a rubber composition into a spherical form to form the core. The rubber composition comprises 10 to 60 parts by weight of a vulcanizer, for example α,β-monoethylenically unsaturated carboxylic acid (such as acrylic acid, methacrylic acid, etc.) or a metal salt thereof, or a functional monomer (such as trimethylolpropane trimethacrylate, and the like), or a combination thereof, 10 to 30 parts by weight of a filler such as zinc oxide, barium sulfate and the like, 0.5 to 5 parts by weight of peroxides such as dicumyl peroxide, etc., and optionally 0.1 to 1; parts by weight of antioxidants based on 100 parts by weight of polybutadiene. The vulcanization may be conducted, for example, by heating at 140° to 170° C. under pressure for 10 to 40 minutes.

The thread wound core comprises a center and a thread rubber layer formed by winding thread rubber in a stretched state around the center, wherein the center may be either liquid center or solid center formed of a rubber composition.

The thread rubber can be the same one as that which has been conventionally used. For example, there can be used those obtained by vulcanizing a rubber composition prepared by formulating an antioxidant, a vulcanization accelerator, sulfur and the like to a natural rubber or a blend rubber of the natural rubber and a synthetic polyisoprene. The examples of a solid core and a thread wound core are only for purpose of illustration, and are not to be construed as limiting.

The method of covering the core with the cover is not specifically limited, but any conventional method may be utilized. For example, there can be used the method comprising molding the cover composition into a semi-spherical half-shell in advance, covering a core with the two half-shells, followed by pressure molding at 130° to 170° C. for 1 to 15 minutes, or alternatively a method comprising injection molding the cover composition directly on the core to cover it. When molding the cover, dimples may be optionally formed on the surface of the golf ball. Furthermore, paint finishing or stamping may be optionally conducted after molding the cover.

One embodiment of the golf ball of the present invention will be explained with reference to the accompanying drawing.

FIG. 1 is a schematic cross section illustrating one embodiment of the golf ball of the present invention. The golf ball in FIG. 1 is a two-piece solid golf ball comprising a core 1 composed of a vulcanized molded article of a rubber composition and a cover 2 formed on the core. The core 1 is "solid core" and is mainly composed of a vulcanized molded article of the rubber composition described above. The cover 2 formed on the core has a thickness of from 0.4 to 1.85 mm, preferably from 0.5 to 1.7 mm, a flexural modulus of from 100 to 1,500 kgf/cm$^2$, preferably from 500 to 1,200 kgf/cm$^2$, and a Shore D hardness of from 30 to 65, preferably from 40 to 55. 2*a* is dimples provided on the cover 2. The golf ball in FIG. 1 comprises the core 1 formed from vulcanizing a molding article of rubber composition having a single layer structure, but a solid core may be used having a multi-layer structure, in which the periphery of the inner core is formed from the vulcanization molding of an article of rubber composition mainly composed of polybutadiene and the outer core is formed from the vulcanization of a molding article of rubber composition mainly composed of polybutadiene having a single layer structure.

Figure 2:
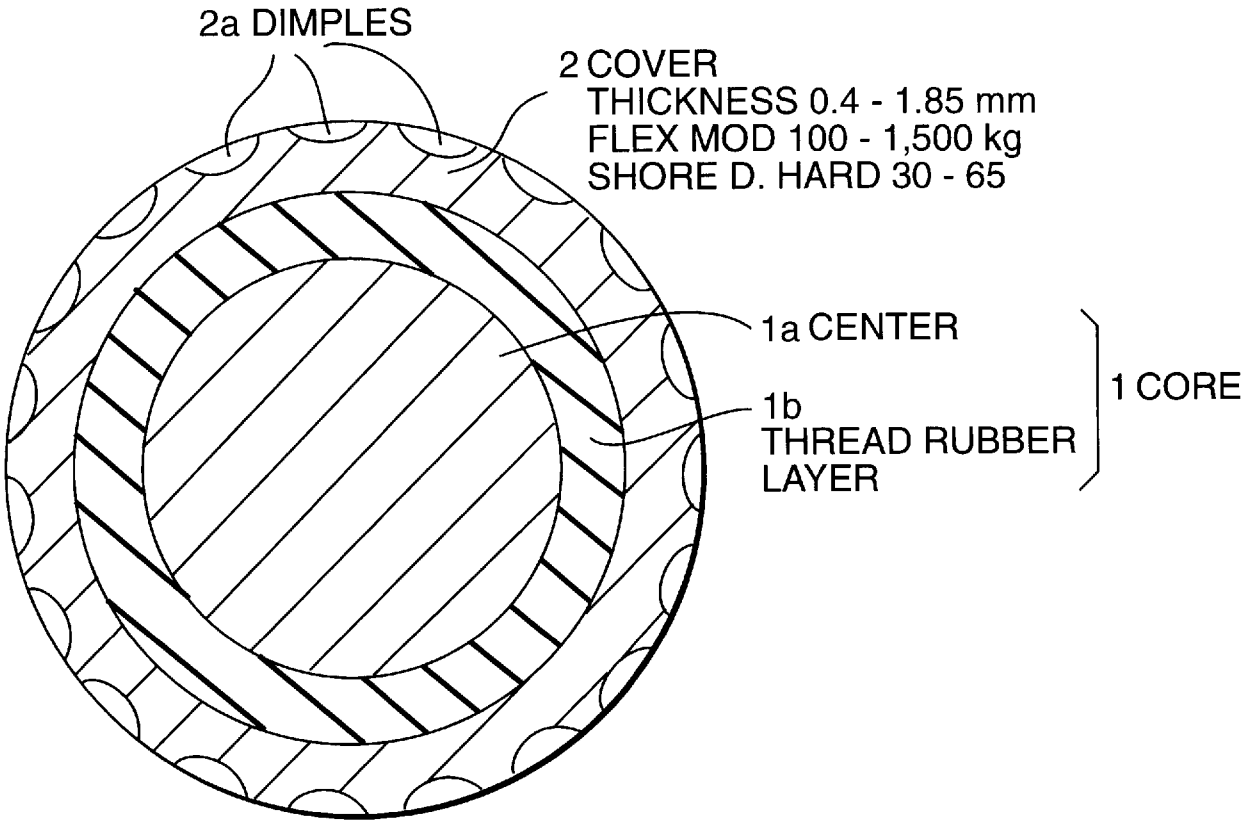
FIG. 2 is a schematic cross section illustrating another embodiment of the golf ball of the present invention.

FIG. 2 is a schematic cross section illustrating another embodiment of the golf ball of the present invention. The golf ball in FIG. 2 is a thread wound golf ball. In FIG. 2, element 1 is a core comprising a center 1*a* and a thread rubber layer 1*b*, element 2 is a cover and 2*a* represents dimples.

The thread rubber used to form the thread rubber layer 1*b* is not limited, but can be the same one as that which is conventionally used. The center 1*a* may, be either a liquid center or a solid center formed of a rubber composition. The thread rubber layer 1*b* is formed by winding thread rubber in a stretched state around the center 1*a*, and the center 1*a* and thread rubber layer 1*b* constitute the core 1 referred to as a "thread wound core". The cover 2 formed on the core 1 has a thickness of from 0.4 to 1.85 mm, preferably from 0.5 to 1.7 mm, a flexural modulus of from 100 to 1,500 kgf/cm$^2$, preferably from 500 to 1,200 kgf/cm$^2$, and a Shore D hardness of from 30 to 65, preferably from 40 to 55.

The dimples 2*a* are provided optionally or according to desired characteristics to the cover 2 of the golf ball in a suitable number and form. Paint finishing or marking may be optionally added to the golf ball.

EXAMPLES

The following Examples and Comparative Examples further illustrate the present invention in detail but are not to be construed to limit the scope thereof.

Examples 1 to 6 and Comparative Examples 1 to 3

Solid golf balls of Examples 1 to 6 and Comparative Examples 1 to 2 were made by the following steps (i) to (iii). A standard thread wound golf ball having a balata cover also was prepared as Comparative Example 3 in order to compare the solid golf balls of Examples 1 to 6 with the standard thread wound golf ball.

(i) Production of solid cores

A rubber composition was prepared by mixing 100 parts by weight of polybutadiene (trade name "BR-11" from Japan Synthetic Rubber Co., Ltd.), 36 parts by weight of zinc acrylate, 20 parts by weight of zinc oxide, 1.2 parts by weight of dicumyl peroxide and 0.5 parts by weight of antioxidant (trade name "Yoshinox 425" from Yoshitomi Pharmaceutical Inds., Ltd.). The rubber composition was vulcanized at 160° C. for 25 minutes to obtain solid cores having the diameter of 41.9 mm, 41.6 mm, 40.8 mm, 40.4 mm, 39.8 mm, 39.6 mm, 38.5 mm and 37.7 mm, respectively. These solid cores have a deformation amount of 2 to 9 mm, which was determined by measuring a deformation amount when applying an initial load of 10 Kg to a final load of 130 Kg.

(ii) Preparation of cover composition

The materials shown in Table 1 and Table 2 were mixed using a kneading type twin-screw extruder to obtain pelletized cover compositions. The formulation composition, flexural modulus and Shore D hardness of the cover compositions A to D used in the golf ball of Example 1 to 4, and Example 7 to 10 respectively are shown in Table 1. The formulation composition, flexural modulus and Shore D hardness of the cover compositions E to F used in the golf ball of Examples 5 to 6, and Examples 11 to 12, and the cover compositions G to H used in the golf ball of Comparative Examples 1 to 2, and Comparative Examples 4 to 5 respectively were shown in Table 2. The amount of each component in the Tables is represented in parts by weight. The components shown as trade names in the Tables are described later in detail.

The extrusion conditions were a screw revolution per minute of 200 rpm, and a screw L/D of 35. The formulation components were heated at 200° to 260° C. at the die position of the extruder. The flexural modulus of the cover described above was determined according to ASTM D-747, using as a sample a heat and press molded sheet having a thickness of about 2 mm from each cover composition, which has been stored at 23° C. for 2 weeks. The Shore D hardness of the cover was determined according to ASTM D-2240, using as a sample a heat and press molded sheet having a thickness of about 2 mm from the cover composition, which has been stored at 23° C. for 2 weeks.

TABLE 1

| Cover composition | | A | B | C | D |
|---|---|---|---|---|---|
| Hi-milan 1555 | *1 | 7 | 0 | 0 | 0 |
| Hi-milan 1855 | *2 | 93 | 0 | 15 | 0 |
| Surlyn AD8511 | *3 | 0 | 20 | 15 | 25 |
| Surlyn AD8512 | *4 | 0 | 25 | 15 | 25 |
| HG-252 | *5 | 0 | 10 | 10 | 30 |
| ESBS AT014 | *6 | 0 | 45 | 0 | 0 |
| ESBS AT015 | *7 | 0 | 0 | 45 | 20 |
| Titanium dioxide | | 2 | 2 | 2 | 2 |
| Barium sulfate | | 2 | 2 | 2 | 2 |
| Flexural modulus (kgf/cm$^2$) | | 1200 | 1100 | 1000 | 800 |
| Shore D hardness | | 55 | 54 | 53 | 50 |

TABLE 2

| Cover composition | E | F | G | H |
|---|---|---|---|---|
| Hi-milan 1855 *2 | 20 | 20 | 0 | 60 |
| Surlyn AD8511 *3 | 5 | 5 | 0 | 0 |
| Surlyn AD8512 *4 | 5 | 5 | 0 | 0 |
| HG-252 *5 | 10 | 10 | 0 | 0 |
| ESBS AT015 *7 | 60 | 0 | 0 | 0 |
| ESBS AT000 *8 | 0 | 60 | 0 | 0 |
| Hi-milan 1605 *9 | 0 | 0 | 50 | 20 |
| Hi-milan 1706 *10 | 0 | 0 | 50 | 20 |
| Titanium dioxide | 2 | 2 | 2 | 2 |
| Barium sulfate | 2 | 2 | 2 | 2 |
| Flexural modulus (kgf/cm$^2$) | 700 | 500 | 3500 | 2000 |
| Shore D hardness | 48 | 46 | 69 | 62 |

*1: Hi-milan 1555 (trade name), ethylene-methacrylic acid copolymer ionomer resin obtained by neutralizing with sodium ion, manufactured by Mitsui Du Pont Polychemical Co., Ltd., flexural modulus = 2,550 kgf/cm$^2$, Shore D hardness = 62

*2: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd., flexural modulus = 917 kgf/cm$^2$, Shore D hardness = 56

*3: Surlyn AD8511 (trade name), ethylene-methacrylic acid copolymer ionomer resin obtained by neutralizing with zinc ion, manufactured by DuPont Co., flexural modulus = 2,240 kgf/cm$^2$, Shore D hardness = 60

*4: Surlyn AD8512 (trade name), ethylene-methacrylic acid copolymer ionomer resin obtained by neutralizing with sodium ion, manufactured by DuPont Co., flexural modulus = 2,850 kgf/cm$^2$, Shore D hardness = 62

*5: HG-252 (trade name), hydrogenated styrene-isoprene-styrene block copolymer having a terminal OH group, manufactured by Kuraray Co. Ltd., JIS-A hardness = 80, content of styrene = 40% by weight

*6: ESBS AT014 (trade name), SBS structure block copolymer having a polybutadiene block with epoxy groups, manufactured by Daicel Chemical Industries, Ltd., JIS-A hardness = 70, styrene/butadiene (weight ratio) = 40/60, content of epoxy = about 0.7–0.9% by weight

*7: ESBS AT015 (trade name), SBS structure block copolymer having a polybutadiene block with epoxy groups, manufactured by Daicel Chemical Industries, Ltd., JIS-A hardness = 67, styrene/butadiene (weight ratio) = 40/60, content of epoxy = about 1.5–1.7% by weight

*8: ESBS AT000 (trade name), SBS structure block copolymer having a polybutadiene block with epoxy groups, manufactured by Daicel Chemical Industries, Ltd., JIS-A hardness = 65, styrene/butadiene (weight ratio) = 40/60, content of epoxy = about 2.9–3.4% by weight

*9: Hi-milan 1605 (trade name), ethylene-methacrylic acid copolymer ionomer resin obtained by neutralizing with sodium ion, manufactured by Mitsui Du Pont Polychemical Co., Ltd., flexural modulus = 3,770 kgf/cm$^2$, Shore D hardness = 67

*10: Hi-milan 1706 (trade name), ethylene-methacrylic acid copolymer ionomer resin obtained by neutralizing with zinc ion, manufactured by Mitsui Du Pont Polychemical Co., Ltd., flexural modulus = 3,360 kgf/cm$^2$, Shore D hardness = 66

(iii) production of golf balls

The solid core obtained in (i) was directly covered by injection molding of the cover composition obtained in (ii) to obtain a two-piece solid golf ball having an outer diameter of 42.7 mm.

With respect to the resulting the golf balls, the weight, ball compression (compression), initial velocity, flight distance (carry) and spin amount were determined, and the cut resistance was evaluated.

The ball compression of the golf balls was determined by the PGA method, and the initial velocity of the golf ball was determined by the R & A initial velocity measuring method. After a No. 1 wood club was mounted to a swing robot manufactured by True Temper Co. and a golf ball was hit at a head speed of 45 m/second, the flight distance (carry) to the dropping point of the hit golf ball were measured.

After a driver (No. 1 wood club), No. 5 iron club and No.9 iron club were respectively mounted to the swing robot described above and a golf ball was hit at head speeds of 38 and 34 m/seconds respectively, the spin amount was measured by taking a photograph of a mark provided on the hit golf ball using a high-speed camera.

After a pitching wedge was mounted to the swing robot described above and a golf ball was hit at a head speed of 30 m/seconds, the cut resistance was evaluated by examining the state of appearance of the cut through a visual check. The evaluation criteria was as described below.

Evaluation criteria

O: No cut

Δ: Small cuts x: Large cuts xx: Cut is too large to fit in practical use

The controllability at approach shot and shot feel of the resulting golf ball were evaluated by 10 top professional golfers according to a practical hitting test. The evaluation criteria are as follows. The results shown in the Tables below are based on the fact that not less than 8 out of 10 professional golfers evaluated the balls with the same criterion about each test item.

Controllability at approach shot

O: Good (spin is readily applied to stop ball easily)

x: Poor

Shot feel:

O: Soft and Good (due to low impact force)

x: poor

The weight, ball compression, initial velocity, flight distance, spin amount, cut resistance, controllability at approach shot and shot feel of the golf ball, together with kind and diameter of core, and thickness, flexural modulus and Shore D hardness of cover used to produce the golf ball of Example 1 to 3 were shown in Table 3, those of Example 4 to 6 were shown in Table 4, and those of Comparative Example 1 to 3 were shown in Table 5.

TABLE 3

| Example No. | 1 | 2 | 3 |
|---|---|---|---|
| Kind of core | Solid | Solid | Solid |
| Diameter of core (mm) | 41.9 | 41.6 | 40.8 |
| Cover composition | A | B | C |
| Thickness of cover (mm) | 0.5 | 0.7 | 1.0 |
| Flexural modulus (kgf/cm$^2$) | 1,200 | 1,100 | 1,000 |
| Shore D hardness of cover | 55 | 54 | 53 |
| Physical properties of golf ball: | | | |
| Weight (g) | 45.3 | 45.3 | 45.4 |
| Compression | 98 | 98 | 97 |
| Initial velocity (ft/sec) | 252.8 | 252.7 | 252.7 |
| Flight distance (yard) | 228 | 229 | 229 |
| Spin amount (rpm): | | | |
| Driver (No. 1 wood club) | 2,950 | 2,900 | 3,000 |
| No. 5 iron club | 5,700 | 5,750 | 5,850 |
| No. 9 iron club | 7,960 | 7,900 | 8,010 |
| Cut resistance | ○ | ○ | ○ |
| Controllability at approach shot | ○ | ○ | ○ |
| Shot feel | ○ | ○ | ○ |

TABLE 4

| Example No. | 4 | 5 | 6 |
|---|---|---|---|
| Kind of core | Solid | Solid | Solid |
| Diameter of core (mm) | 40.4 | 39.8 | 39.6 |
| Cover composition | D | E | F |
| Thickness of cover (mm) | 1.3 | 1.5 | 1.7 |
| Flexural modulus (kgf/cm$^2$) | 800 | 700 | 500 |
| Shore D hardness of cover | 50 | 48 | 46 |
| Physical properties of golf ball: | | | |
| Weight (g) | 45.4 | 45.3 | 45.4 |
| Compression | 97 | 97 | 97 |
| Initial velocity (ft/sec) | 252.8 | 252.8 | 252.8 |
| Flight distance (yard) | 228 | 229 | 229 |
| Spin amount (rpm): | | | |
| Driver (No. 1 wood club) | 3,050 | 3,100 | 3,100 |
| No. 5 iron club | 5,800 | 5,900 | 5,850 |
| No. 9 iron club | 7,950 | 8,100 | 8,100 |
| Cut resistance | ○ | ○ | ○ |
| Controllability at approach shot | ○ | ○ | ○ |
| Shot feel | ○ | ○ | ○ |

TABLE 5

| Comparative Example No. | 1 | 2 | 3 |
|---|---|---|---|
| Kind of core | Solid | Solid | * |
| Diameter of core (mm) | 38.5 | 37.7 | * |
| Cover composition | G | H | * |
| Thickness of cover (mm) | 2.1 | 2.5 | * |
| Flexural modulus (kgf/cm$^2$) | 3,500 | 2,000 | * |
| Shore D hardness of cover | 69 | 60 | * |
| Physical properties of golf ball: | | | |
| Weight (g) | 45.3 | 45.3 | 45.3 |
| Compression | 97 | 98 | 90 |
| Initial velocity (ft/sec) | 251.9 | 252.5 | 252.2 |
| Flight distance (yard) | 226 | 226 | 224 |
| Spin amount (rpm): | | | |
| Driver (No. 1 wood club) | 2,700 | 2,800 | 4,000 |
| No. 5 iron club | 4,200 | 4,500 | 5,800 |
| No. 9 iron club | 6,800 | 6,900 | 8,000 |
| Cut resistance | ○ | Δ | xx |
| Controllability at approach shot | x | x | ○ |
| Shot feel | x | x | ○ |

*Thread wound golf ball comprising balata cover.

As is apparent from the physical properties of the golf balls of Examples 1 to 6 shown in Table 3 and 4 compared with those of the golf balls of Comparative Examples 1 to 3 shown in Table 5, the golf balls of Examples 1 to 6 have longer flight distance and more spin amount with a middle iron shot and a short iron shot than those of Comparative Examples 1 to 3, and better controllability with approach shots, better shot feel and better cut resistance when compared to those of Comparative Examples 1 to 3. The solid golf ball, in which the cover has a thickness of from 0.4 to 1.85 mm, a flexural modulus of from 100 to 1,500 kgf/cm$^2$ and a Shore D hardness of from 30 to 65, has proper spin amount at utilizing a driver or, a long flight distance of 228 to 229 yards, excellent flight performance, and the same level of spin amount as the middle iron and short iron shot of the golf ball of Comparative Example 3 which is a standard thread wound golf ball having a balata cover. The solid golf ball also has good controllability and shot feel, and excellent cut resistance.

On the contrary, the golf balls of Comparative Examples 1 to 2 are poor in flight distance, controllability with approach shots and shots feel in comparison with the balls of Examples 1 to 6. Also, the thread wound golf ball having a balata cover of Comparative Example 3 has shorter flight distance, and poorer cut resistance than those of Examples 1 to 6.

Examples 7 to 12 and Comparative Examples 4 to 6

Thread wound golf balls having an outer diameter of 42.7 mm were prepared through the following steps (i) to (ii).

(i) Production of thread wound cores

Firstly, a rubber composition was prepared according to the formulation shown in Table 6. The resulting rubber composition was charged in a mold for creating a center and vulcanized at 160° C. for 25 minutes to obtain solid centers having a diameter of 32.4 mm. The amount of each component in the Tables is represented in parts by weight.

The JIS-A hardness, weight and diameter of the resulting center are measured, and the results were shown in Table 6.

TABLE 6

| | |
|---|---|
| JSR BR11 *11 | 100 |
| Nippol 2007J *12 | 30 |
| Sulfur | 10 |
| Vulcanization aid *13 | 7 |
| Vulcanization accelerator *14 | 1.5 |
| Weight adjustor *15 | 70 |
| Diameter (mm) | 32.4 |
| JIS-A hardness | 87 |
| Weight (g) | 23.2 |

*11: JSR BR11 (trade name), High cis-polybutadiene available from Japan Synthetic Rubber Co., Ltd., having 1,4-cis-polybutadiene content of 96%
*12: Nippol 2007J (trade name), Highstyrene resin available from Nippon Zeon Co., Ltd.
*13: A combinaton of zinc white Ginryo R (trade name, zinc oxide available from Toho Aen Co., Ltd.) of 5 parts by weight and stearic acid (available from nippon Yushi Co., Ltd.) of 2 parts by weight
*14: Noccelar TT (trade name, tetramethylthiuram disulfide available from Ohuchi Shinko Kagaku Kogyo Co., Ltd.) of 0.25 parts by weight and Noccelar CZ-G (trade name, N-cyclohexyl-2-benzothiazyl sulfenamide available from Ohuchi Shinko Kagaku Kogyo Co., Ltd.) of 1.25 parts by weight
*15: Balium sulfate (available from Sakai Kagaku Kogyo Co., Ltd.)

Then, thread wound cores having the diameter of 41.9 mm, 41.6 mm, 40.8 mm, 40.4 mm, 39.8 mm, 39.6 mm, 39.0 mm and 37.7 mm, respectively, such that they were desirable for using in each of Examples and Comparative Examples, were obtained by winding thread rubber prepared from a blend rubber of natural rubber/low cis-isoprene rubber [Shell IR-309 (trade name), available from Shell Chemical Co., Ltd.]=50/50 (weight ratio) as base rubber in the stretched state around the resulting centers to form a thread rubber layer. These thread wound cores have a deformation amount of 2.7 mm, determined by measuring a deformation amount when applying an initial load of 10 Kg to a final load of 130 Kg.

(ii) Preparation of thread wound golf balls

The cover compositions prepared in the step (ii) of Examples 1 to 6 and Comparative Examples 1 to 3 were molded in semi-spherical half-shells in advance, covering a thread wound core of the step (i) with the two half-shells, followed by press molding in the mold and coating with a paint to obtain a thread golf ball having an outer diameter of 42.7 mm. In production of the thread golf ball, the cover composition A described above was used in the thread golf ball of Example 7; the cover composition B described above was used in the thread golf ball of Example 8; the cover composition C described above was used in the thread golf ball of Example 9; the cover composition D described above was used in the thread golf ball of Example 10; the cover composition E described above was used in the thread golf ball of Example 11; the cover composition F described above was used in the thread golf ball of Example 12; the cover composition G described above was used in the thread golf ball of Comparative Example 4; and the cover composition H described above was used in the thread golf ball of Comparative Example 5.

With respect to the resulting thread wound golf balls, the weight, ball compression (compression), initial velocity, flight distance and spin amount were determined, and cut resistance, controllability at approach shot and shot feel were evaluated.

The weight, ball compression, initial velocity, flight distance, spin amount, cut resistance, controllability at on approach shots and shots feel of the golf ball, together with type and diameter of core, and thickness, flexural modulus and Shore D hardness of the cover used to produce the golf ball of Examples 7 to 9 were shown in Table 7; those of Example 10 to 12 were shown in Table 8; and those of Comparative Examples 4 to 6 were shown in Table 9. The golf ball of Comparative Example 6 is a standard thread wound golf ball, and is the same as that of Comparative Example 3 described above.

TABLE 7

| Example No. | 7 | 8 | 9 |
|---|---|---|---|
| Kind of core | T.W.* | T.W. | T.W. |
| Diameter of core (mm) | 41.9 | 41.6 | 40.8 |
| Cover composition | A | B | C |
| Thickness of cover (mm) | 0.5 | 0.7 | 1.0 |
| Flexural modulus (kgf/cm$^2$) | 1,200 | 1,100 | 1,000 |
| Shore D hardness of cover | 55 | 54 | 53 |
| Physical properties of golf ball: | | | |
| Weight (g) | 45.3 | 45.3 | 45.4 |
| Compression | 98 | 98 | 97 |
| Initial velocity (ft/sec) | 252.8 | 252.7 | 252.7 |
| Flight distance (yard) | 228 | 229 | 229 |
| Spin amount (rpm): | | | |
| Driver (No. 1 wood club) | 2,950 | 2,900 | 3,000 |
| No. 5 iron club | 5,700 | 5,750 | 5,850 |
| No. 9 iron club | 7,960 | 7,900 | 8,010 |
| Cut resistance | ○ | ○ | ○ |
| Controllability at approach shot | ○ | ○ | ○ |
| Shot feel | ○ | ○ | ○ |

*Thread wound

TABLE 8

| Example No. | 10 | 11 | 12 |
|---|---|---|---|
| Kind of core | T.W.* | T.W. | T.W. |
| Diameter of core (mm) | 40.4 | 39.8 | 39.6 |
| Cover composition | D | E | F |
| Thickness of cover (mm) | 1.3 | 1.5 | 1.7 |
| Flexural modulus (kgf/cm$^2$) | 800 | 700 | 500 |
| Shore D hardness of cover | 50 | 48 | 46 |
| Physical properties of golf ball: | | | |
| Weight (g) | 45.4 | 45.3 | 45.4 |
| Compression | 97 | 97 | 97 |
| Initial velocity (ft/sec) | 252.8 | 252.8 | 252.8 |
| Flight distance (yard) | 228 | 229 | 229 |

TABLE 8-continued

| Example No. | 10 | 11 | 12 |
|---|---|---|---|
| Spin amount (rpm): | | | |
| Driver (No. 1 wood club) | 3,050 | 3,100 | 3,100 |
| No. 5 iron club | 5,800 | 5,900 | 5,850 |
| No. 9 iron club | 7,950 | 8,100 | 8,100 |
| Cut resistance | ○ | ○ | ○ |
| Controllability at approach shot | ○ | ○ | ○ |
| Shot feel | ○ | ○ | ○ |

*Thread wound

TABLE 9

| Comparative Example No. | 4 | 5 | 6 |
|---|---|---|---|
| Kind of core | T.W.* | T.W. | ** |
| Diameter of core (mm) | 39.0 | 37.7 | ** |
| Cover composition | G | H | ** |
| Thickness of cover (mm) | 2.0 | 2.5 | ** |
| Flexural modulus (kgf/cm$^2$) | 3,500 | 2,000 | ** |
| Shore D hardness of cover | 69 | 60 | ** |
| Physical properties of golf ball: | | | |
| Weight (g) | 45.3 | 45.3 | 45.3 |
| Compression | 97 | 98 | 90 |
| Initial velocity (ft/sec) | 252.0 | 252.5 | 252.2 |
| Flight distance (yard) | 224 | 226 | 224 |
| Spin amount (rpm): | | | |
| Driver (No. 1 wood club) | 3,650 | 3,400 | 4,000 |
| No. 5 iron club | 4,400 | 4,600 | 5,800 |
| No. 9 iron club | 6,900 | 7,200 | 8,000 |
| Cut resistance | Δ | Δ | xx |
| Controllability at approach shot | x | x | ○ |
| Shot feel | x | x | ○ |

*Thread wound
**Thread wound golf ball comprising balata cover.

In these thread wound golf balls, it is shown that, when the physical properties of the golf balls of Examples 7 to 12 shown in Table 7 and 8 are compared with those of the golf balls of Comparative Examples 4 to 6 shown in Table 9, the golf balls of Examples 7 to 12, similarly as Examples 1 to 6 described above, have flight distance and spin amount at the middle iron shot and the short iron shot more than those of Comparative Examples 4 to 6, and better controllability with approach shots, shots feel and cut resistance than those of Comparative Examples 4 to 6. The thread wound golf ball, in which the cover has a thickness of from 0.4 to 1.85 mm, a flexural modulus of from 100 to 1,500 kgf/cm$^2$ and a Shore D hardness of from 30 to 65, has proper spin amount using a driver shot, long flight distance of 228 to 229 yards, excellent flight performance, and the same level of spin amount with middle iron shots and a short iron shots as the golf ball of Comparative Example 6 which is a standard thread wound golf ball comprised balata type cover, good controllability and shot feel, and excellent cut resistance.

On the contrary, the golf ball of Comparative Examples 4 to 5 have lower flight distance, particularly poorer controllability with approach shots and shots feel than those of Examples 7 to 12. Also, the thread wound golf ball with the balata type cover of Comparative Example 6 has a lower flight distance, particularly poorer cut resistance than those of Examples 7 to 12.

As is apparent from the above results, there is provided by the present invention a golf ball having good shot feel and controllability with approach shots, and excellent flight performance and cut resistance, according to the present invention.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A golf ball comprising a core and a cover formed on the core, wherein said cover is formed from a mixture of an ionomer resin and an epoxy group containing a polymer or an OH group containing a soft elastomer and has a thickness of from 0.4 to 1.85 mm, a flexural modulus of from 100 to 1,500 kgf/cm$^2$, and a Shore D hardness of from 30 to 65.

2. The golf ball of claim 1, wherein the epoxy group containing polymer is a SBS structured block copolymer having polybutadiene blocks with epoxy groups.

3. The golf ball of claim 1, wherein the OH group containing soft elastomer is a hydrogenated styrene-isoprene-styrene block copolymer having terminal OH groups.

4. The golf ball of claim 1, wherein the core has single layer structure.

5. The golf ball of claim 1, wherein the core has a two-layer structure comprising a center surrounded by a thread rubber layer.

* * * * *